United States Patent [19]

Larsen

[11] 4,165,041

[45] Aug. 21, 1979

[54] SHELL LINER ASSEMBLY FOR ORE GRINDING MILLS

[75] Inventor: Darrell R. Larsen, Salt Lake City, Utah

[73] Assignee: Minneapolis Electric Steel Castings Company, Minneapolis, Minn.

[21] Appl. No.: 874,398

[22] Filed: Feb. 2, 1978

[51] Int. Cl.[2] ..... B02C 17/22

[52] U.S. Cl. ..... 241/182; 241/299

[58] Field of Search ..... 241/181, 182, 183, 284, 241/299

[56] References Cited

U.S. PATENT DOCUMENTS

| | | | |
|---|---|---|---|
| 1,128,901 | 2/1915 | Possect | 241/183 |
| 1,534,000 | 4/1925 | Baker | 241/183 |
| 1,872,036 | 8/1932 | Hardinge | 241/182 X |
| 3,462,090 | 8/1969 | Landes et al. | 241/299 |
| 3,582,007 | 6/1971 | Heighberler | 241/183 |
| 3,630,459 | 12/1971 | Slegten | 241/183 |
| 3,680,799 | 8/1972 | Hallerback | 241/183 |
| 3,804,346 | 4/1974 | Norman | 241/182 |
| 3,949,943 | 4/1976 | Schuler et al. | 241/183 |
| 4,018,393 | 4/1977 | Larsen | 241/182 |

FOREIGN PATENT DOCUMENTS

| | | | |
|---|---|---|---|
| 1131489 | 6/1962 | Fed. Rep. of Germany | 241/183 |
| 2305311 | 8/1974 | Fed. Rep. of Germany | 241/182 |
| 47-4388 | 3/1967 | Japan | 241/182 |
| 8619 | of 1914 | United Kingdom | 241/183 |

*Primary Examiner*—Howard N. Goldberg

*Attorney, Agent, or Firm*—Merchant, Gould, Smith, Edell, Welter & Schmidt

[57] ABSTRACT

A liner assembly for the shell or drum of an ore grinding machine. The liner assembly comprises a plurality of liner segments each of which defines a mounting surface constructed for mounting engagement with the inner shell surface and a grinding surface for comminuting the ore. Each of the segments has longitudinal sides that taper from the grinding surface to the mounting surface. When mounted in side-by-side relation, adjacent liner segments define a pocket between opposed, tapered sides. A wedge-shaped insert is disposed within each pocket and loosely retained therein by the opposed tapered surfaces to reduce the amount of particulate matter entering the pocket and to protect the inner surface of the shell. In the preferred embodiment, the ends of each segment may likewise be tapered toward the mounting surface so that pockets are also defined by the opposed ends of adjacent liner segments, and inserts are also loosely retained in these pockets.

16 Claims, 7 Drawing Figures

SHELL LINER ASSEMBLY FOR ORE GRINDING MILLS

The invention is generally related to apparatus for comminuting ore, and is specifically directed to an improved liner assembly for an ore grinding mill used in commercial mining operations. The invention represents an improvement in liner assemblies of the type disclosed in my earlier U.S. Pat. No. 4,018,393, which issued on Apr. 19, 1977, and U.S. Pat. No. 4,046,326 which issued on Oct. 12, 1977.

Briefly, ore grinding mills typically consist of a large cylindrical drum which is rotated about a horizontal axis. The axial ends of the drum are open, and the material to be comminuted is continuously fed into the mill at one end with the comminuted product continuously emerging from the other end.

Because many ores such as taconite are extremely hard and highly abrasive in order to maintain continuous operation of the grinding mill, it is necessary to provide a liner for the drum which is highly abrasion resistant, and which also is tough enough to withstand the continuous impact or ore fragments. Often, grinding mills of this type employ rods or balls to assist in the comminuting process, which further compounds the problem of wear.

Abrasion resistant liners are necessarily segmented (i.e., constructed from a plurality of components) for a number of reasons, including the limited size of mill access openings and the significant size and weight of the liner taken as a whole. Thus, the liner is typically constructed from a plurality of bar segments which may be axially aligned within the cylindrical drum and individually secured. The aforementioned U.S. Pat. No. 4,018,393 is directed to an improved procedure and apparatus for securing abrasion resistant liner segments to the cylindrical shell of an ore grinding machine. The liner segments are formed with sockets of a special shape and disposed at predetermined intervals, and are held within the cylindrical shell by bolts having heads received in the sockets, and threaded shanks passing through the liner segments and the mill shell to receive nuts at the outer surface. The sockets and heads are shaped to provide continuous flat contact areas of substantial size regardless of variations in center distances of holes axially along the shell.

The liner segments are preferably formed with irregular, ridged surfaces, which has been found to improve the efficiency of the mill. However, this irregular configuration of liner segments does not lend itself to fabrication from materials which are highly abrasion resistant, such as martensitic white iron and martensitic steel. Materials such as these undergo a significant volume change as they pass from the austenitic stage to martensitic form, and it is extremely difficult to form from such materials an article of significant size or complex configuration since the transformation from martensite (as the result of rapid cooling) may crack the article and render it useless in an ore crushing application. For this reason, the segmented liners have often been made from a "tough" material which offers relatively good resistance to impact, although its resistance to abrasion is somewhat lower.

The aforementioned U.S. Pat. No. 4,046,326 discloses and claims an improved liner assembly in which a "tough" material is used for the primary structure of the liner segment, coupled with the usage of one or more inserts formed from highly abrasion resistant material in a manner such that the insert or inserts represent primary exposure to ore fragments but are always retained even if they break due to brittleness. This is accomplished through the formation of an opening extending entirely through the liner segment, and which has tapered sides converging toward the exposed surface. The insert or inserts are of conforming shape and size, having similarly converging sides which engage and wedge against those of the segment opening. The inserts are placed into the segment opening from its back or unexposed side, projecting through to the exposed surface, but being retained in this position by the wedging action. As the liner segment is bolted to the shell, the insert or inserts are positively and rigidly retained, capable of comminuting the ore, but incapable of escape. Accordingly, the hard, abrasion resistant material is surrounded are retained by the tough, impact resistant material.

My earlier patents thus represent an improvement in securing the individual segments to the mill drum, and extending the life of the segments (and therefore the entire liner assembly) through the use of abrasion resistant inserts. The invention of this application is directed to structure which assists in the removal of liner segments for replacement purposes.

The individual liner segments are mounted in spaced relation, so that gaps exist between each segment and adjacent segments. This is done for several reasons, one of which is that there must be a fair degree of tolerance to accommodate the varying segment positions permitted by the mounting approach taken in U.S. Pat. No. 4,018,393. It would be possible to construct a liner segment from a plurality of segments the dimensions of which are machined to close tolerances, but this simply is not economically feasible with martensitic steel of this size, and it would make installation more difficult.

The problem created by having gaps between adjacent segments is that material passing through the mill with the ore becomes lodged in the gaps and causes the segments to stick together. This problem is more acute with ball mills because the balls tend to fragment with increased wear, and these particles also enter and become lodged in the gaps. Peening of the segments likewise increases with usage, also forcing the individual segments together. The combined effect of material forced between the gaps and segment peening results in the liner assembly becoming integral, which substantially increases the difficulty of removing the individual liner segments when replacement is ncessary. Often, removal of the segments takes more time than installation, which results in substantial downtime of the mill. This has serious economic effects, since many ore processing plants operate on a 24-hour per day basis.

This invention offers a solution to the problem which is structurally simple while entirely effective. The segment bodies are generally rectangular, and preferably bar-shaped. In the preferred embodiment, the longitudinal sides and shorter ends of the bar segment are tapered so that, with the segment in a mounted position, the sides and ends converge from the grinding side of the segment to the mounting side. Each of these tapered surfaces defines with the opposed tapered surface of an adjacent segment a pocket which is generally triangular in cross section and extends either the length or the width of the segments. When the liners are mounted, a wedge or triangularly shaped insert is placed into each pocket, where it is loosely retained. The inserts correspond in length to the segment length or width, depending on the application.

Because each of the segment bodies tapers toward and into its mounted position, it is more easily removed when the time comes for replacement, notwithstanding the accumulation of fragmented material in the gaps between the segment bodies and wedge-shaped inserts, or peening of the segment bodies together.

It will be appreciated that it is the tapered sides themselves which facilitate removal of the bar segment. Stated otherwise, removal of the bar segments is simplified whether or not a wedge-shaped insert is used. However, the wedge-shaped insert offers protection to the liner in those surface areas in which exposure has been increased due to the pockets.

In its broadest form, the invention comprises forming the liner segments with sides which taper so that the cross sectional dimension of the segment decreases as it approaches the surface which makes contact with the liner. The pockets defined between adjacent segment bodies, and the protective inserts, may vary in configuration while providing the same function.

DESCRIPTION OF THE PREFERRED EMBODIMENT

Figure 1:
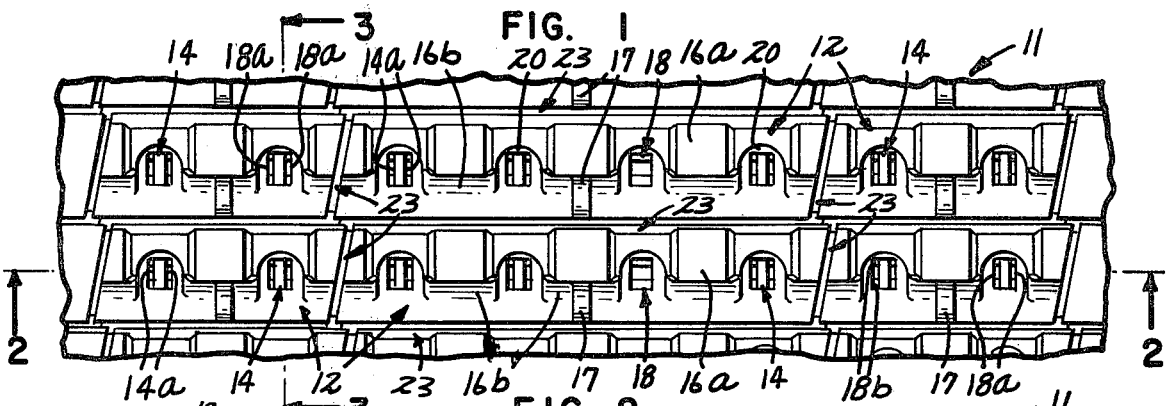
FIG. 1 is a fragmentary view showing a segmented liner assembly for an ore grinding mill according to the invention and viewed radially outward from within the mill.

With reference to the figures, a liner assembly embodying the invention is represented generally by the numeral 11. Liner assembly 11 comprises a plurality of individual liner segments 12 which are secured to a cylindrical drum 13 and cover virtually the entire inner cylindrical surface of drum 13. As shown in FIG. 1, the segments 12 are arranged in longitudinal rows which are disposed in alignment with the rotational axis of the drum. In the preferred assembly, the liner segments 12 also define circumferential rows.

Figure 3:
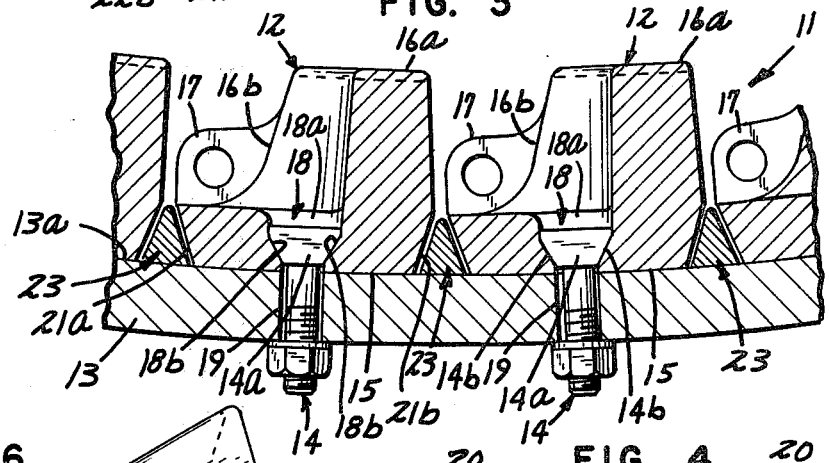
FIG. 3 is an enlarged fragmentary sectional view taken along the line 3—3 of FIG. 1.
Figure 6:
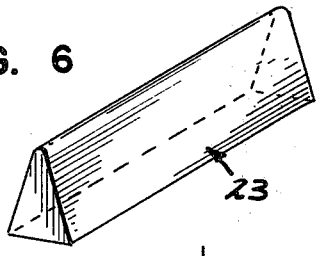
FIG. 6 is a perspective view of a wedge-shaped insert which is disposed between adjacent segment sides or segment ends in the assembled position.
Figure 4:
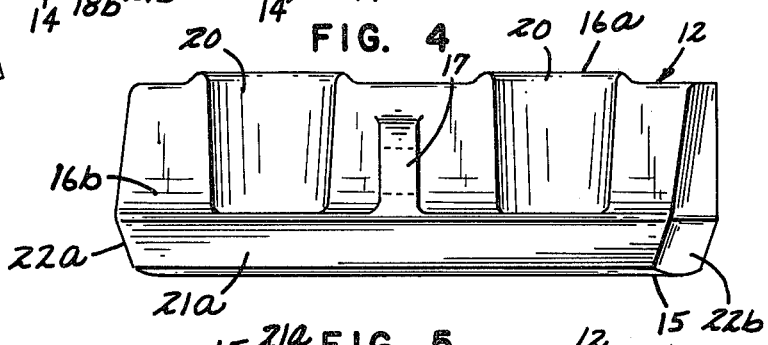
FIG. 4 is a view in side elevation of one of the individual segment bodies, showing with particularity the tapered configuration of the segment sides and ends.

As particularly shown in FIGS. 3 and 4, each of the liner segments 12 has a mounting surface 15 which is slightly curved to conform to the inner cylindrical surface 13*a* of drum 13, such curvature being exaggerated in FIG. 4 for purposes of clarity.

Each of the liner segments 12 is also formed with an inner grinding surface of irregular contour, defining an elevated tumbling ridge 16*a* and a lower convex surface 16*b*. A centrally disposed lifting hook 17 projects from the convex surface 16*b*. Thus, as particularly shown in FIG. 3, the overall configuration of the liner grinding surface is undulated, defined by alternating, axially extending ridges and valleys, which together increase the effectiveness of the tumbling and ore grinding process as the drum 13 rotates.

Figure 2:
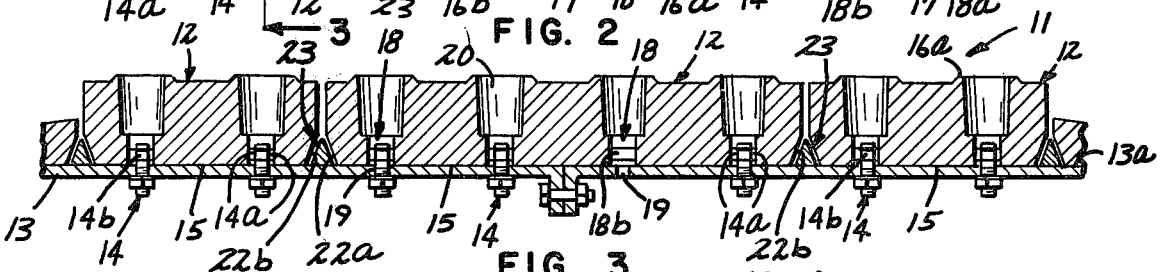
FIG. 2 is a fragmentary sectional view taken along the line 2—2 of FIG. 1.

As shown in FIGS. 1 and 2, the segment bodies 12 are of two lengths, and each is formed with two or four mounting openings 18 which are registrable with corresponding mounting openings 19 in the drum 13 to receive the nut and bolt assemblies 14.

To accommodate the mounting bolts, each of the segments 12 is formed with arcuate recesses 20 which extend into that portion of the segment body defining the elevated tumbling ridge 16*a*. Each of the arcuate recesses 20 partially surrounds a mounting opening or socket 18.

Each of the mounting sockets 18 is defined by a pair of opposed straight walls 18*a* which are disposed generally perpendicular to the axis of the liner. The walls 18*a* are spaced in the direction of the axis of the liner by a distance somewhat greater than the width of the associated bolt head. The bolt socket 18 has a second pair of opposed walls 18*b* (FIG. 3) which diverge from the socket bottom to define oblique planar surfaces, and then extend for a short distance perpendicularly to the inner cylindrical surface of the drum 13.

The bolt of the assembly 14 includes a threaded shank and a head which conforms generally to the bolt socket 18. Thus, each bolt head has opposed, flat parallel surfaces 14*a* (FIG. 1) which are disposed in opposed relation to the straight walls 18*a*, and tapered sides 14*b* conforming to the oblique socket surfaces 18*b* (FIG. 3). The distance between the flat surfaces 14*a* is considerably less than the distance between the straight walls 18*a* of socket 18, thus affording a degree of relative lateral movement between the bolt head and the segment body 12. This enables the threaded shank of the bolt to at all times extend perpendicularly through the drum 13 and hold the liner segments 12 to the shell 13 without improper, concentrated stresses. At the same time, this structural configuration permits rapid mounting of the liner segments 12 to the drum 13 due to the leeway in mounting socket 18/mounting hole 19 alignment. Reference is made to the aforementioned U.S. Pat. No. 4,018,393 for additional details of the structure and cooperative function of the nut and bolt assemblies 14 with the mounting sockets 18 and mounting openings 19.

In the preferred embodiment, each of the segment bodies 12 is trapezoidal in shape, being formed with oblique, parallel ends.

The segment bodies 12 ultimately become worn during the ore comminuting process and require replacement. As discussed above, a problem arises from material entering the cracks between the segment body sides and ends, coupled with peening of the segment bodies to the point that the liner assembly becomes integral; i.e., the segment bodies are effectively joined together and as such resist removal.

To overcome this problem, each of the segment bodies 12 is relieved along each longitudinal side and end to define tapered side surfaces 21*a*, 21*b*, and tapered end surfaces 22*a*, 22*b*. As constructed, the opposed tapered surfaces 21*a*, 21*b* and 22*a*, 22*b* converge toward the mounting surface 15; and, accordingly, the cross sectional dimension of each segment body 12 decreases as the mounting surface 15 is approached.

The longer segment bodies 12 may as an example be on the order of 60 inches in length and 15 inches in width, with the shorter segment bodies 12 being one the order of 30 inches in length with the same width. The segment body height (i.e., the maximum distance between the tumbling ridge 16*a* and the mounting surface 15) is on the order of 10 inches. For dimensions such as these, the angle of taper of each of the surfaces 21*a*, 21*b*, 22*a*, 22*b* is on the order of 20°, and the taper extends approximately 3 inches from the mounting surface 15 toward the grinding surface 16.

As shown in FIGS. 2 and 3, the opposed tapered side surfaces and end surfaces of adjacent body segments 12 are flat, defining longitudinal, triangular pockets, and a wedge-shaped insert 23 is placed in each of these pockets as the individual segment bodies 12 are bolted into place. The inserts 23 generally correspond in size and shape to the pockets, and have a length corresponding essentially to the length of the segment body 12, or to its width, depending on the application.

As shown in FIG. 1, inserts of three different lengths are used between the longer segment body sides, the shorter segment body sides, and the segment ends. For the exemplary dimensions mentioned above, it is possible to use inserts 23 of a single length which would generally correspond to the segment body width. Thus, a single inset 23 would be used between adjacent ends, two such inserts 23 would be used between adjacent sides of shorter segment bodies 12, and four inserts 23 would be used between adjacent longitudinal sides of the longer segment bodies 12. This of course is a matter of production preference.

Figure 7:
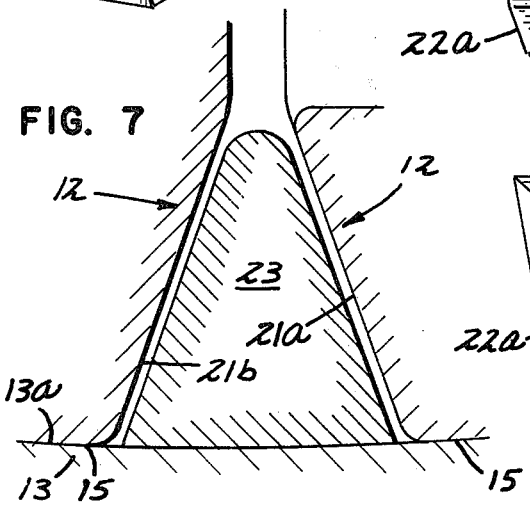
FIG. 7 is an enlarged sectional view of one of the wedge-shaped inserts, showing in particular its relation to adjacent segment bodies and the mill liner surface.
Figure 5:
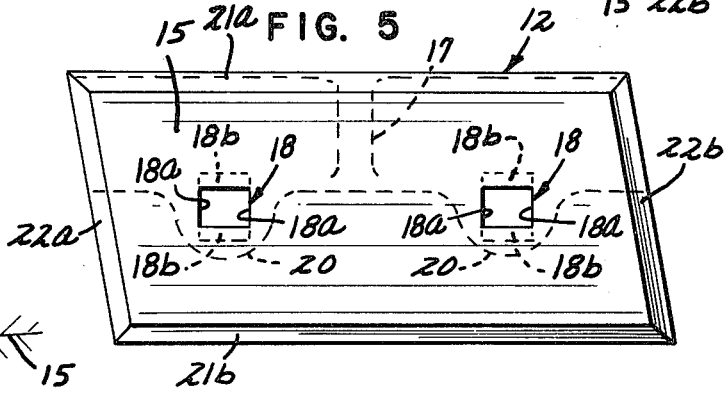
FIG. 5 is a view in bottom plan of the segment body, also showing the tapered configuration of the sides and ends.

FIG. 7 shows the relationship of one of the inserts 23 relative to the tapered surfaces 21*a*, 21*b* of adjacent segment bodies 12. Although the wedge-shaped insert 23 is loosely retained in the triangular pocket, it precludes the entry of any substantial amount of material between the segment bodies 12; and, more importantly, offers protection to the inner cylindrical surface 13*a* of liner 13. It has been pointed out above that the inserts 23 are not required in facilitating removal of the segment bodies 12, but are used in the preferred embodiment to prevent the entry of particulate material in the gaps between segments bodies 12, thereby offering significant protection to the inner cylindrical surface 13*a* of the liner 13.

An ore comminuting machine is provided with a new liner assembly 11 by individually mounting the segment bodies 12, preferably in axial rows. Depending on the radius of the mill drum, it is possible that inserts 23 be placed between the ends of adjacent segment bodies 12 after they have been mounted by the nut and bolt assemblies 14. After an axial row of segment bodies 12 is in place, inserts 23 are loosely laid over the length of the exposed tapered surface, followed by mounting of another axial row of segment bodies 12, thus loosely retaining the inserts 23.

After the liner assembly 11 has been used to the point of requiring liner replacement, the nuts of nut and bolt assemblies 14 are removed from the external side of the mill drum, and the individual segment bodies 12 are relatively easily removed due to the converging tapered surfaces and reduction in cross sectional dimension, which results in a reversed wedge relation.

What is claimed is:

1. A removable liner assembly for the shell of an ore grinding machine, comprising:

(a) a plurality of liner segments, each of which comprises a segment body defining a mounting surface constructed for mounting engagement with the shell surface and a grinding surface for comminuting the ore, each segment body defining opposite sides that at least in part taper toward said mounting surface;

(b) means for connecting each liner segment to the shell of the ore grinding machine;

(c) the liner segments being mounted with tapered sides in side-by-side, opposed relation, defining a pocket between said opposed, tapered sides;

(d) and insert means disposed in each of said pockets for reducing the amount of particulate matter entering said pocket and protecting the inner surface of the shell, each insert means being so configured that it is loosely retained within the associated pocket without direct connection to the shell.

2. The liner assembly defined by claim 1, wherein the insert means has a length generally corresponding to the length of the associated pocket.

3. The liner assembly defined by claim 2, wherein the tapered surfaces are flat, defining a triangularly shaped pocket, and the inserts are wedge-shaped.

4. The liner assembly defined by claim 1, wherein each segment body defines opposed, parallel longitudinal sides and ends, each of which at least in part tapers toward said mounting surface.

5. The liner assembly defined by claim 1, wherein the insert means comprises an elongated member having a cross section generally corresponding to the pocket.

6. The liner assembly defined by claim 5, wherein each segment body defines opposed, parallel longitudinal sides and ends that at least in part taper toward said mounting surface, the liner segments being assembled in rows to define pockets between adjacent tapered longitudinal sides and adjacent ends, with insert means disposed in each of said pockets.

7. The liner assembly defined by claim 6, wherein the tapered surfaces are flat, defining a triangularly shaped pocket, and the insert means are wedge-shaped.

8. The liner assembly defined by claim 1, wherein the liner segments are assembled in rows to define pockets between adjacent tapered longitudinal sides and adjacent ends, and insert means are disposed in each of said pockets.

9. The liner assembly defined by claim 8, wherein each insert means has a length generally corresponding to the length of the associated pocket.

10. A removable liner assembly for the shell of an ore grinding machine, comprising:

(a) a plurality of liner segments, each of which comprises a segment body of predetermined size and configuration and defining a mounting surface constructed for mounting engagement with the shell surface and the grinding surface for comminuting the ore;

(b) each of said segment bodies defining opposed, parallel longitudinal sides and ends, each of which at least in part tapers toward the mounting surface;

(c) and means for connecting each liner segment to the shell of the ore grinding machine.

11. The liner assembly defined by claim 10, wherein the liner segments are assembled in rows to define pockets between adjacent tapered longitudinal sides and adjacent ends, and further comprising insert means disposed in said pockets.

12. The liner assembly defined by claim 11, wherein the insert means comprises an elongated member having a cross section generally corresponding to the pocket.

13. The liner assembly defined by claim 12, wherein the insert means has a length generally corresponding to the length of the associated pocket.

14. A removable liner assembly for the shell of an ore grinding machine, comprising:

(a) a plurality of liner segments, each of which comprises a segment body defining a mounting surface constructed for mounting engagement with the shell surface and a grinding surface for comminuting the ore, each segment body further defining opposite sides and ends;

(b) means for connecting each liner segment to the shell of the ore grinding machine with the liner segment sides disposed in side-by-side, opposed relation;

(c) the sides of the liner segments being so configured that a retaining pocket communicating with the shell surface is formed between the opposed sides of adjacent segment bodies;

(d) and insert means retainably disposed in each of said pockets for reducing the amount of particulate matter entering said pocket and protecting the inner surface of the shell, each insert means being so configured that it is loosely retained within the associated pocket without direct connection to the shell.

15. The liner assembly defined by claim 14, wherein the insert means comprises an elongated member having a cross section generally corresponding to the retaining pocket.

16. The liner assembly defined by claim 14, wherein the inserts are substantially wedge-shaped.

* * * * *